United States Patent [19]

Shiga

[11] 3,986,970

[45] Oct. 19, 1976

[54] SOLUTION FOR CHEMICAL DISSOLUTION TREATMENT OF TIN OR ALLOYS THEREOF

[75] Inventor: Shoji Shiga, Nikko, Japan

[73] Assignee: The Furukawa Electric Co., Ltd., Tokyo, Japan

[22] Filed: Apr. 26, 1974

[21] Appl. No.: 464,295

[30] Foreign Application Priority Data

| | | |
|---|---|---|
| May 2, 1973 | Japan | 48-49348 |
| May 2, 1973 | Japan | 48-49349 |
| May 29, 1973 | Japan | 48-59969 |
| July 24, 1973 | Japan | 48-83296 |

[52] U.S. Cl. ..... 252/79.3; 156/18; 156/20

[51] Int. Cl.[2] ..... C09K 13/08

[58] Field of Search ..... 252/79.1–79.5, 252/142; 156/3, 7, 18, 20; 75/97 R, 97 A, 98; 134/3, 41

[56] References Cited

UNITED STATES PATENTS

| | | | |
|---|---|---|---|
| 2,318,559 | 5/1943 | Percival | 156/20 X |
| 2,377,593 | 6/1945 | Vande Bunte | 252/79.2 |
| 2,428,464 | 10/1947 | Lum et al. | 252/79.2 |
| 2,441,300 | 5/1948 | Vande Bunte | 252/79.2 |
| 2,561,222 | 7/1951 | Passal | 156/18 X |
| 2,711,364 | 6/1955 | Beach | 156/20 |
| 3,537,926 | 11/1970 | Fischer | 252/79.3 X |
| 3,556,883 | 1/1971 | Naito et al. | 252/79.4 X |
| 3,565,707 | 2/1971 | Radimer et al. | 156/18 X |
| 3,615,950 | 10/1971 | Lacal | 156/18 X |
| 3,677,949 | 7/1972 | Brindisi et al. | 156/18 X |
| 3,841,905 | 10/1974 | Dixon | 156/3 X |

*Primary Examiner*—William A. Powell
*Attorney, Agent, or Firm*—Carroll Palmer

[57] ABSTRACT

A solution for chemical dissolution treatment (for example, pickling, etching, chemical milling, chemical polishing or leaching) of tin or its alloys which comprises an aqueous solution of an acid, an oxidizing agent and 0.001 to 10 mole/l of at least one inorganic compound selected from the group consisting of fluorides, inorganic fluoric complex salts, titanium salts, trivalent chromium salts, iron salts, antimony salts and vanadium salts.

9 Claims, No Drawings

SOLUTION FOR CHEMICAL DISSOLUTION TREATMENT OF TIN OR ALLOYS THEREOF

This invention relates to a solution for chemical dissolution treatment of tin or its alloys and more particularly to an aqueous solution consisting of acid, oxidizing agent and tin ion stabilizing agent.

Hitherto, treatment of tin or its alloys by chemical dissolution, for example, pickling, etching, chemical milling or chemical polishing has generally been carried out with an aqueous solution consisting of strong acid and oxidizing agent such as chromic acid or nitric acid. However, any of the prior art treating processes uses materials evolving extremely poisonous substances such as hexavalent chromic ion and nitrogen oxide gas, requiring large equipment and expenditure for prevention of environmental pollution and improvement of work site environments. Accordingly, these conventional processes are now found not only uneconomical but also undesirable from the standpoint of taking measures for environmental safety.

In view of the above-mentioned situation, it is contemplated to utilize an aqueous solution consisting of inorganic peroxide, for example, hydrogen peroxide, persulfate, or perborate and sulfuric acid, sulfamic acid, phosphoric acid or hydrochloric acid, namely, an acidic solution of peroxide. Application of said solution to tin or its alloys, however, causes the dissolved stannous ion to be oxidized by peroxide, generating white colloidal metasaonnic acid according to the following equation (I):

$$\left.\begin{array}{l} Sn^{++} + 2H^{+} + H_2O_2 \longrightarrow Sn^{4+} + 2H_2O \\ Sn^{4+} + 3H_2O \longrightarrow H_2SnO_3\downarrow + 4H^{+} \end{array}\right\} \quad (I)$$

This reaction rapidly proceeds and is accompanied with the drawback that the surface of the exposed metal is contaminated by a filmy smut of metastannic acid to obstruct any further dissolution of tin. In an important conventional industrial field different from that in which tin or its alloys alone are treated by chemical dissolution using any of the above-mentioned processes, there has been practically applied a process of dissolving tin or its alloys coated on copper material and recovering said base copper material for reuse without its dissolution. For example, there has already been proposed (for example, Japanese Pat. No. 16740 and Japanese Pat. Publication No. 4857/52) a process of immersing scraps of the copper material coated with tin or alloys thereof which has passed its effective life or scraps obtained as the result of machining in manufacturing a similarly clad copper material in an aqueous solution consisting of acid and copper salt as an oxidizing agent and selectively dissolving tin or its alloys coated on the copper material through substitution thereof by the copper ion dissolved in the solution due to the different ionization tendencies of copper and tin according to the following equation (II):

$$Sn + Cu^{++} \rightarrow Sn^{++} + Cu\downarrow \quad (II)$$

Though the above-mentioned process can be easily operated by simple equipment and is considered available for practical application, yet the solution used is unstable for the two reasons given below, resulting in the low purity of copper material recovered, the difficulty of continuing a stable operation and in consequence decreased productivity.

1. Divalent tin ion dissolved out into the solution is oxidized into an unstable tetravalent form by atmospheric oxygen to generate metastannic acid as indicated by the following equation (III):

$$Sn^{++} + 1/2O_2 + H_2O \rightarrow H_2SnO_3\downarrow + 2H_2 \quad (III)$$

This metastannic acid is deposited on the surface of the copper material in the form of white film, leading to the low purity of the copper measuring recovered.

2. Particularly where copper ion is present, a reaction represented by the above equation (III) rapidly proceeds. Namely, the presence of only about 10 ppm of copper ion in an acidic solution of tin vigorously promotes said reaction even at room temperature. As a result, the solution presents a white turbid state, and the copper ion is partly reduced to metallic copper or cuprous oxide. Since an attempt for the rapid progress of the purification reaction of the equation (II) at high temperature gives rise to the generation of metastannic acid with the resultant obstruction of operation, the customary practice has been to carry out said purification at room temperature, consuming several hours. Even at room temperature, the metastannic acid is formed and settles on the surface of copper of copper alloy material, requiring a step of eliminating said deposited metastannic acid. Further, the colloidal fine precipitate of metastannic acid in the solution is extremely difficult to remove.

As mentioned above, any of the prior art processes of treating tin or alloy thereof by chemical dissolution was accompanied with the drawback that regardless of the object for which said treatment was intended, a smut of metastannic acid was formed on the surface of metal material (for example, copper material) during the chemical dissolution to obstruct its progress.

It is accordingly an object of this invention to provide a solution for chemical dissolution treatment of tin or alloys thereof capable of effecting said dissolution without the formation of a smut of metastannic acid.

Another object of the invention is to provide a solution of long effective life for chemical dissolution treatment of tin or alloys thereof.

Still another object of the invention is to provide a solution for chemical dissolution treatment of tin or alloys thereof which enables only the coating of tin or alloys thereof to be dissolved off base copper material for it easy recovery.

According to an aspect of this invention, there is provided a solution for chemical dissolution treatment of tin or alloys thereof which comprises an aqueous solution consisting of 0.03 to 10 mole/l of an oxidizing agent; 0.1 to 10 gram ion/l in terms of hydrogen ion concentration of an acid; 0.001 to 10 mole/l of at least one tin ion-stabilizing agent selected from the group consisting of a fluoride, an inorganic fluoric complex salt containing a fluorine atom as a ligand, a titanium salt, a trivalent chromium salt, an iron salt, an antimony salt and a vanadium salt; and water as the remainder.

In this invention, tin alloys include bronze, phosphor bronze, lead-tin solder and nickel-tin alloys, though the invention is not limited thereto.

As used herein, copper material coated with tin or alloys thereof is defined to mean copper or alloys thereof whose surface is partly or wholly covered with tin or alloys thereof. The copper material coated with tin or alloys thereof includes electrically conductive material consisting of pure copper wire or bronze wire plated in a thickness of 0.5 to 5 microns with tin or tin alloys containing, for example, a small amount of lead, antimony or cadmium; solder-plated copper or copper alloys used as wiring for electronic apparatuses; and copper or copper alloys used in soldered electrical parts or heat exchangers (for example, automobile radiators).

As used herein, the term "coat" is defined to mean same or different kinds of metal chemically or metallurgically attached or bonded to each other, for example, metals integrally combined together by electroplating, hot-dip coating, vacuum evaporation coating, metallizing, etc., mechanically compounded metals, and welded metal parts. However, the invention is not limited thereto. As used herein, the term "chemical dissolution treatment" is defined to mean the process of chemically dissolving part or the whole of metals as well as of metal compounds such as products of corrosion deposited on the surface of metals. Industrially, said treatment includes pickling, etching, chemical milling, chemical polishing and dissolution treatment of a mixture of metals for recovery of part of metal components (leaching).

An oxidizing agent used in this invention includes inorganic peroxides such as hydrogen peroxide, persulfate and perborate and salts of metal having a nobler ionization tendency than tin. Any of these oxidizing agents dissolves metals in co-operation with acid. Where the oxidizing agent is contained in the solution of the invention in a smaller concentration than 0.03 mole/l, then it will display a low oxidizing effect. On the other hand, where the concentration of said oxidizing agent exceeds 10 mole/l, it will be difficult to expect a correspondingly higher oxidizing effect. Therefore, use of such unduly large amount of oxidizing agent will simply mean a waste. Accordingly, the concentration of the oxidizing agent used in this invention is 0.03 to 10 mole/l.

Where a coating of tin or an alloy thereof alone is dissolved off the base copper material, it is preferred to use as an oxidizing agent the salt of a metal displaying a nobler ionization tendency than tin.

Where part or the whole of the base copper material coated with tin or an alloy thereof is dissolved together with said coating, or where tin or an alloy thereof alone is treated by chemical dissolution, then it is desired to use any of the above-mentioned inorganic peroxides as an oxidizing agent.

Where the oxidizing agent consists of the salt of a metal displaying a nobler ionization tendency than tin, then said salt of a metal is preferred to have a concentration of 2 to 50 g/l in terms of the metal contained in said salt.

The higher the concentration of an oxidizing agent falling within a range allowed in this invention, the quicker the chemical dissolution effected by the solution of the invention containing said oxidizing agent. Particularly where the oxidizing agent consists of an inorganic peroxide used in a higher concentration than the acid contained in the solution, then chemical polishing can be effectively carried out.

Acids used in this invention include sulfuric acid, sulfamic acid, phosphoric acid and hydrochloric acid, whose hydrogen ion is desired to have a concentration of 0.1 to 10 gram ion/l. While sulfuric acid is customarily accepted due to its low cost, acetic acid, sulfamic acid, fluoroborosilicic acid, etc. are favorably used to treat tin alloys containing lead by chemical dissolution. Where the acid has a lower concentration of hydrogen ion than 0.1 gram ion/l, then the solution is practically ineffective for chemical dissolution of metals. Where the concentration of the hydrogen ion rises above 10 gram ion/l, then said chemical dissolution is decreased. Therefore, these unduly lower and higher concentrations of hydrogen ion are excluded from the range in this invention.

The tin ion-stabilizing agent used in this invention is at least one compound selected from the group consisting of soluble fluorides; inorganic fluoric complex compounds containing a fluorine atom as a ligand; titanium salts; trivalent chromium salts; iron salts; antimony salts; and vanadium salts. To give concrete examples, said tin ion-stabilizing agent includes sodium floride; ammonium hydrogen fluoride; fluoric acid; sodium fluoroborate; sodium hexafluorosilicate; potassium hexafluorotitanate; potassium hexafluorozirconate; artificial cryolite; titanium monosulfate; titanium disulfate; titanium trichloride; chromium sulfate; chromium alum; iron alum; ferric fluoride; antimony sulfate; ammonium metavanadate; and sodium orthovanadate. All the above-listed compounds are effective in stabilizing stannous ion and preventing the precipitation of metastannic acid and the formation of its smut.

A lower concentration of the tin ion-stabilizing agent than 0.001 mole/l undesirably fails to display any practical effect. While said agent presents a larger effect with its increasing concentration, a higher concentration than 10 mole/l can not be expected to indicate a correspondingly greater tin ion-stabilizing effect. Therefore, use of such unduly larger concentration is not only uneconomical but also impractical. Therefore, the tin ion-stabilizing agent should be used in concentrations ranging from 0.001 to 10 mole/l, or preferably from 0.05 to 5 mole/l.

Among the above-listed tin ion-stabilizing agents, use of fluorides or fluoric complex salts containing a fluorine atom as a ligand together with salts of metals, for example, titanium prevents the formation of metastannic acid particularly over a long period. Therefore, where tin or alloys thereof are treated by chemical dissolution particularly at such a high temperature as 40° C, it is preferred to use fluorine-containing compounds. Among these fluorine-containing compounds, fluoric complex compounds containing a fluorine atom as a ligand are practically more effective than fluorides. The reason is that fluoric acid derived from said complex compounds, for example, hexafluorotitanic acid or fluoroboric acid has a far smaller toxicity or corrosiveness than hydrogen fluoride derived from said fluorides such as sodium fluoride generated in the acidic solution of the invention. This also holds true with waste liquid discharged from a tin or tin alloy-chemically dissolving plant. Where a solution of fluorides carried along with said waste liquid is neutralized even by calcium hydroxide, it is difficult to reduce the residual amount of fluorine to a lower level than 10 ppm. In contrast, hexafluorotitanic acid or hexafluorosilicates can be neutralized down to 2–3 ppm by the same neutralizing agent.

As mentioned above, the chemical dissolution solution of this invention is applied to various objects for which said chemical dissolution is intended by properly controlling the proportions of the three components. However, said solution may further include 8-oxyquinoline, salts of condensated phosphoric acid, urea, aliphatic alcohol or carboxylic acid as a stabilizer of the inorganic peroxides used in this invention. Where the solution is used particularly at a high temperature, this peroxide stabilizing agent displays a prominent effect.

This invention will be more fully understood by reference to the following experiments, examples and controls.

EXPERIMENT 1

Experiments for measuring suppression effect to copper formation were made to measure a length of time required for the formation of precipitated copper where fluorine ion or fluorine-containing complex ion was added to the acidic solution of a copper salt containing divalent tin ion ($Sn^{++}$).

The solutions used each had a volume of 300 ml and consisted of 1 gram/l by copper concentration of copper sulfate, 15 gram/l by tin ion ($Sn^{++}$) concentration of stannous sulfate, 100 gram/l of sulfuric acid and various fluorine compounds added at different fluorine concentrations given in Table 1 below. With these solutions allowed to stand at a temperature of about 15° C, observation was continued for 30 days of the precipitation of copper, the results being also set forth in Table 1 below.

Table I

| Concentrations of fluorine compounds added (g/l) | | Time required for the formation of precipitated copper (day) |
|---|---|---|
| Without any fluorine compound | | 1 |
| NaF | 0.01 | 1 |
| NaF | 0.05 | 2 |
| NaF | 0.1 | 3 |
| NaF | 1.0 | 16 |
| NaF | 10.0 | No precipitation of copper arose even 30 days after addition |
| $Cu(BF_4)_2$ | 0.05 | 2 |
| $Cu(BF_4)_2$ | 0.1 | 2 |
| $Cu(BF_4)_2$ | 1.0 | 18 |
| $Cu(BF_4)_2$ | 10.0 | No precipitation of copper arose even 30 days after addition |
| $Na_2SiF_6$ | 10.0 | No precipitation of copper arose even after 30 days after addition |
| $Na_2TiF_6$ | 1.0 | 15 |
| $Na_2TiF_6$ | 10.0 | No precipitation of copper arose even after 30 days after addition |

As apparent from Table 1 above, a reddish precipitate of copper appeared in a solution containing no fluorine compound only one day after the experiment was commenced. A reddish precipitate of copper also appeared in a solution containing 0.01 g/l of sodium fluoride (NaF) only one day after addition of said fluorine compound. In contrast a similar reddish precipitate of copper was formed in 2 days in case of 0.05 g/l addition of NaF and in 3 days in case of 0.1 g/l addition thereof. Thus it was found that a larger addition of NaF than 0.05 g/l began to restrict the precipitation of copper. An increasing addition of NaF displayed a larger effect to suppress said precipitation, namely, 1 g/l addition of NaF allowed copper to be precipitated only 16 days after said addition. 10 g/l addition of NaF fully prevented the occurrence of any copper precipitate during the 30-day experiment. Substantially the same tin-stabilizing effect was observed with respect to the fluoroboric ion, hexafluorosilicic ion and hexafluorotitanic ion.

EXPERIMENT 2

Experiments were made to measure a length of time required for the formation of metastannic acid by adding metal salts including various metal ions to the following acidic solutions of metal salts containing sulfuric acid.

Solutions each having a volume of about 300cc were prepared by adding metal salts including various metal ions shown in Table 2 to an aqueous acidic solution consisting of 10 g Cu/l of copper sulfate, 10 g Sn/l of stannous sulfate and 200 g/l of sulfuric acid. The mixed solutions thus prepared were allowed to stand at 30° C, and measurement was made of a length of time required for the formation of precipitated metastannic acid over a period of 60 days, the results being set forth in Table 2 below. As seen from Table 2, the precipitation of metastannic acid was effectively restricted by addition of the above-mentioned metal salts including metal ions. Higher concentrations of ferrous ion than 0.05 g/l (Samples 3 to 7) presented the effect of suppressing the formation of metastannic acid. At a concentration of 1 g/l, said suppressing effect or the tin stabilizing effect began to be prominent at a substantially constant rate. Ferric ion (Sample 8) was also effective, though said effect was slightly smaller than that of the ferrous ion. Iron acetate (Sample 10) had a similarly large effect. Chromium ion (Sample 11) and titanium ion (Samples 13, 14) had a particularly prominent effect. Antimony ion (Sample 12) and vanadium ion (Samples 15, 16) indicated a slightly smaller effect. Addition of fluorine ion to ferrous ion (Sample 18) and fluorosilicic ion to ferrous ion (Sample 19) was found more effective to suppress the formation of metastannic acid. Said suppressing effect was prominently attained by a combination of titanium ion and hexafluorotitanic ion (Samples 20 to 23).

Table 2

| Sample | Additive | Concentration | Time required for the formation of precipitation of metastanic acid (day) |
|---|---|---|---|
| *1 | None | — | 1 |
| 2 | $FeSO_4$ | 0.01 g/Fl | 1 |
| 3 | $FeSO_4$ | 0.05 g/Fl | 2 |
| 4 | $FeSO_4$ | 0.1 g/Fl | 5 |
| 5 | $FeSO_4$ | 1.0 g/Fl | 30 |
| 6 | $FeSO_4$ | 10.0 g/Fl | 35 |
| 7 | $FeSO_4$ | 50.0 g/Fl | 33 |
| 8 | $Fe(SO_4)_3$ | 10.0 g/Fl | 25 |

Table 2-continued

| Sample | Additive | Concentration | Time required for the formation of precipitation of metastanic acid (day) |
|---|---|---|---|
| 9 | $FeBO_4$ | 5 g/Fl | 30 |
| | $Fe(SO_4)_3$ | 5 g/Fl | |
| 10 | $Fe(CH_3COO)_2$ | 1 g/Fl | 31 |
| 11 | $Cr_2(SO_4)_2$ | 5 g-Cr/l | >60 |
| 12 | $Sb_2(SO_4)_3$ | 1 g-Sb/l | 20 |
| 13 | $TiCl_3$ | 5 g-Ti/l | >60 |
| 14 | $Ti(SO_4)_2$ | 5 g-Ti/l | >60 |
| 15 | $NaVO_3$ | 3 g-V/l | 10 |
| 16 | $H_2VO_3$ | 3 g-V/l | 24 |
| 17 | $Fe(BF_4)_2$ | 5 g-Fe/l | >60 |
| 18 | $FeSO_4$ | 1 g-Fe/l | 43 |
| | NaF | 1 gF/l | |
| 19 | $FeSO_4$ | 1 g-Fe/l | 45 |
| | $Na_2SiF_6$ | 1 g-F/l | |
| 20 | $Ti(SO_4)_2$ | 1 g-Ti/l | 39 |
| | $Na_2TiF_6$ | 0.01 g-F/l | |
| 21 | $Ti(SO_4)_2$ | 1 g-Ti/l | 50 |
| | $Na_2TiF_6$ | 1 g-F/l | |
| 22 | $Ti(SO_4)_2$ | 1 g-Ti/l | >60 |
| | $Na_2TiF_6$ | 1 g-F/l | |
| 23 | $Ti(SO_4)_2$ | 1 g-Ti/l | >60 |
| | $Na_2TiF_6$ | 1 g-F/l | |

*Control

EXPERIMENT 3

Various materials listed in Table 3 below were added to an aqueous solution consisting of 15 g/l of sodium persulfate, 120 g/l of sulfuric acid, 5 g Sn/l of stannous sulfate, 1 g/l of copper sulfate and 5 cc/l of ethyl alcohol. The mixed solutions thus prepared were allowed to stand at 50° C. Measurement was made of a length of time required for the formation of a white precipitate, the results being set forth in Table 3.

Where any of the additives shown in Table 3 was not used, the solution presented a white turbidity in less than one hour and a white brownish precipitate of metastannic acid appeared within several hours, proving that the solution was very unstable. However, addition of as small an amount as 0.0001 mole/l of sodium fluoroborate was observed to have a tendency to suppress the precipitation of metastannic acid. 0.001 mole/l particularly, more than 0.01 mole/l of said borate was found effective in suppressing said precipitation. At a higher concentration than 0.1 mole/l, said borate displayed a substantially constant prominent suppressing effect. This was also true of sodium fluoride and titanium sulfate. Particularly effective were potassium hexafluorotitanate and potassium hexafluorozirconate. Iron fluoroborate and a combination of sodium fluoroborate and titanium sulfate presented a noticeable effect even at a low concentration.

Table 3

| Additive | Concentration (g mole/l) | Time required for formation of precipitation (day) |
|---|---|---|
| None | — | White precipitate appeared in less than 1 hour |
| $NaBF_4$ | 0.0001 | White precipitate appeared within several hours |
| $NaBF_4$ | 0.001 | 2 |
| $NaBF_4$ | 0.01 | 15 |
| $NaBF_4$ | 0.1 | 25 |
| $NaBF_4$ | 1 | 24 |
| $NaBF_4$ | 5 | 25 |
| NaF | 0.5 | 22 |
| NaF | 5 | 23 |
| NaF | 15 | 23 |
| $Na_2SiF_6$ | 0.5 | 20 |
| $K_2TiF_6$ | 0.5 | 30 |
| $K_2ZrF_6$ | 0.5 | 31 |
| $Na_3AlF_6$ | 0.5 | 21 |
| $Ti(SO_4)_2$ | 0.0001 | White precipitate appeared within several hours |

Table 3-continued

| Additive | Concentration (g mole/l) | Time required for formation of precipitation (day) |
|---|---|---|
| $Ti(SO_4)_2$ | 0.001 | 1 |
| $Ti(SO_4)_2$ | 0.1 | 9 |
| $Ti(SO_4)_2$ | 1 | 11 |
| $K_2Cr_2(SO_4)_2.24H_2O$ | 0.1 | 14 |
| $Fe_2(SO_4)_3$ | 0.025 | 10 |
| $Fe(BF_4)_3$ | 0.05 | 24 |
| $Sb_2(SO_4)_3$ | 0.05 | 4 |
| $Na_3VO_4.14H_2O$ | 0.05 | 4 |
| $NaBF_4$ | 0.05 | 25 |
| $Ti(SO_4)_2$ | 0.05 | |
| $FeF_3$ | 0.05 | 18 |

EXAMPLE 1

Scraps of tin-plated copper electric wires of 0.3 to 1 mm diameter covered with plastic material were mechanically cut up into small pieces several mm long, and the plastic covering was peeled off. 10 g of short-cut tin-plated copper wires (the plated tin component accounting for 0.41% of the total weight of said wires) was placed in a 20 liter drum made of polyvinyl chloride and lined with "Saran" cloth. This drum was improvised from a barrel type plated apparatus having the outer walls bored with a large number of small holes for the free passage of liquid and made 10 rotations per minute.

While held in said drum, the short-cut tin-plated copper wires were immersed in an aqueous solution capable of chemically dissolving tin which was maintained at a temperature of 35° C. Immersion was continued 2 hours while the drum was kept rotating. The aqueous solution had the following composition:

| | |
|---|---|
| $H_2SO_4$ | 50 g/l |
| $CuSO_4$ | 5 g/l (as copper concentration) |
| NaF | 10 g/l (as fluorine concentration) |

After immersed 2 hours in the above aqueous solution, the content of the drum was water washed, followed by drying. Now said content was found to be short wires of copper substantially free from tin layers. Spectroscopic analysis showed that the amount of tin still sticking to the short copper wires was only as minute as 20 ppm. Several lots of above-mentioned short-cut tin-plated copper wires were successively subjected to the tin-dissolving operation in the similar tin-dissolving aqueous solution simply by replenishing sometimes with a sufficient amount of copper sulfate to maintain the amount of copper dissolved in said solution within the range of 1 to 5 g/l. Though the amount of tin dissolved as $Sn^{++}$ in said solution increased to 30 g/l as a result of the repeated tin-dissolving operations, the solution still remained substantially transparent. Further, the residual amount of tin still sticking to the copper wires after each dissolving operation was as small as 20 ppm.

CONTROL 1 (PRIOR PROCESS)

Dissolution of tin was carried out in the same manner as in Example 1, using substantially the same tin-dissolving aqueous solution, except that sodium fluoride was not added at all. As an increasing amount of tin was dissolved, the solution became more turbid with a brownish color, obviously due to the precipitation of copper and the formation of metastannic acid. When the amount of tin in the solution rose to about 30 g/l, as large an amount as 210 ppm of tin was still retained on the surface of the short-cut copper wires thus treated. Even though water washing was repeated for a period of three times longer than in the above case, yet the amount of still retained tin was only reduced to 140 ppm. Such a large residual amount of tin retained on the surface of the short-cut copper wires was due to the firm attachment of the precipitated metastannic acid to said surface.

EXAMPLES 2 to 6

Scraps of tin-plated copper electric wires of 0.3 to 1 mm diameter covered with plastic material were mechanically cut up into small pieces several mm long, and the plastic covering was peeled off. 10g of short-cut tin-plated copper wires (the plated tin component accounting for 0.41% of the total weight of said wires) was placed in the same 20 liter drum as in Example 1. While held in said drum, several lots of the short-cut tin-plated copper wires were immersed 1 hour in acidic solutions having the compositions shown in Table 4 below and maintained at 30° C, while the drum was kept rotating. After said immersion, each drum content was water washed, followed by drying. Chemical analysis of each drum content gave the results described in Table 5 under the respective items of Examples (2) to (6). A tin-dissolving operation was often repeated with the same kind of solution by sometimes replenishing with a sufficient amount of copper sulfate to maintain the amount of dissolved copper within 5 to 10 g/l. Even when the amount of tin in the solution increased to 30 g/l, the solution remained transparent with a green color, and the amount of residual tin sticking to the copper wires thus treated was reduced to less than 80 ppm in all cases.

Table 4

| | Composition of solution | |
|---|---|---|
| Example 2 | $H_2SO_4$ | 100 g/l |
| | $CuSO_4$ | 10 g-Cu/l |
| | $FeSO_4$ | 5 g-Fe/l |
| Example 3 | $H_2SO_4$ | 1100 g/l |
| | $CuSO_4 4$ | 10 g-Cu/l |
| | $Ti(SO_4)_2$ | 10 g-Ti/l |
| Example 4 | $H_2SO_4$ | 100 g/l |
| | $CuSO_4$ | 10 g-Cu/l |
| | $Cr_2(SO_4)_2$ | 3 g-Cr/l |
| Example 5 | $H_2SO_4$ | 100 g/l |
| | $CuSO_4$ | 10 g-Cu/l |
| | $Sb_2(SO_4)_3$ | 1 g-Sb/l |
| Example 6 | $H_2SO_4$ | 100 g/l |
| | $CuSO_4$ | 10 g-Cu/l |
| | Ammonium metavanadate | 2 g-V/l |
| | Artificial cryolite | 1 g-F/l |

Table 5

| | |
|---|---|
| Example 2 | Even when the amount of tin in the solution rose to 30 g/l, the solution remained transparent with a green color, and the amount of residual tin attached to the copper wires was reduced to less than 80 ppm (lower limit of chemical analysis). |
| Example 3 | Even when the amount of tin in the solution increased to 30 g/l, the solution remained transparent, and the amount of residual tin attached to the copper wires was reduced to less than 80 ppm. |
| Example 4 | Even when the amount of tin in the solution rose to 30 g/l, the solution remained transparent, and the amount of residual tin attached to the copper wires was decreased to less than 80 ppm. |
| Example 5 | Even when the amount of tin in the solution increased to 30 g/l, the solution remained substantially transparent with a green color, and the amount of residual tin attached to the copper wires was reduced to less than 80 ppm. |
| Example 6 | Even when the amount of tin in the solution increased to 30 g/l, the solution remained transparent with a blue color, and the amount of residual tin attached to the copper wires was decreased to less than 80 ppm. |

CONTROL 2

Scraps of tin-plated copper wires covered with plastic material were subjected to the tin-dissolving operation in the same manner as in Example 2, except that the tin-dissolving solution did not contain iron sulfate. As the amount of dissolved tin increased, the solution became turbid with a brownish gray color, obviously due to the formation of metastannic acid and the precipitation of copper. When the amount of dissolved tin rose to about 30 g/l, residual tin still attached to the copper wires indicated as large an amount as 210 ppm. Though water washing was applied for a period three times that used in Example 2, the amount of said residual tin was only reduced to 140 ppm. Such a large amount of residual tin resulted from the firm attachment of metastannic acid to the copper wires thus treated.

EXAMPLE 7

5 kg of the 4–5 cm long scraps of 0.3 to 1.0 mm diameter electric wires of phosphor bronze plated with solder (Sn/Pb = 6/4) for use with electronic apparatuses which were obtained in working said wires for practical application were placed in a cylindrical polyethylene tank. A solution of the following composition:

| | |
|---|---|
| $HBF_4$ | 50 g/l |
| $Cu(BF_4)_2$ | 5 g-Cu/l |
| $Fe(BF_4)_2$ | 5 g-Fe/l |

was introduced into the tank from below and made to circulate therethrough while overflowing from the tank top. After treatment of 10 to 20 minutes by the above circulating solution at 45° C, the phosphor bronze base of the scraps was all exposed. 30 minutes after commencement of said treatment, the solution was drawn off and the exposed base-metal was water washed. When spectroscopically analyzed, a piece of the lump obtained by melting together some exposed base-metal wires indicated 20 ppm of residual lead still attached thereto. The same treatment was often repeated by replenishing with a sufficient amount of copper fluoroborate to maintain the concentration of copper dissolved in the solution within the range of 3 to 7 g/l. Even when said treatment was continued until an amount of tin in the solution increased to 30 g/l, the solution remained transparent with a blue color. After each treatment, an amount of residual lead sticking to the exposed phosphor bronze wires was only about 20 ppm.

EXAMPLE 8

100 kg of 4.0 mm diameter phosphor bronze coil containing 8% of tin was annealed at 600° C in an atmosphere containing a small amount of residual air. The coil thus treated had its surface oxidized with a brown color. The oxidized coil was immersed 10 minutes at room temperature in a solution of the following composition:

| | |
|---|---|
| $H_2O_2$ | 10 g/l |
| $H_2SO_4$ | 100 g/l |
| $Ti(SO_4)_2$ | 5 g/l |
| $Na_4P_2O_7$ | 15 g/l |

When washed with cold and hot water and then dried, the coil presented a very bright surface.

Hitherto, such coil has been treated by a mixed solution of sulfuric acid and sodium bichromate. However, this process required special equipment for treatment of waste liquid and water containing extremely poisonous hexavalent chromium ion. It was also found hopelessly impossible to treat a sludge derived from the neutralization of the above-mentioned waste into a harmless state.

CONTROL 3

The same kind of phosphor bronze coil as in Example 8 was immersed in a solution of substantially the same composition as in Example 8 except for a titanium component. The exposed surface of the coil was contaminated by a white filmy precipitate. Though washed with water and then sprayed with water after immersion of 10 minutes in said solution, the coil was found to be tainted by said white deposition not only throughout the inside but also partly on the outside. When dried, the coil had its surface covered with white powders.

EXAMPLE 9

The same kind of phosphor bronze coil as in Example 8 was immersed for 7 minutes in a solution of the following composition at 50° C:

| | |
|---|---|
| $(NH_4)_2SeO_8$ | 20 g/l |
| $H_2SO_4$ | 100 g/l |
| $Na_2SiF_6$ | 5 g/l |
| $Fe_2(SO_4)_3$ | 5 g-Fe/l |

When washed with cold and hot water and then dried, the coil presented a very bright surface.

EXAMPLE 10

The same kind of phosphor bronze coil as in Example 8 was immersed for 5 minutes at room temperature in a solution of the following composition:

| | |
|---|---|
| $NaBO_3.4H_20$ | 70 g/l |
| $NH_2SO_3H$ | 100 g/l |
| $Na_2TiFe$ | 10 g/l |
| n-propyl alcohol | 5 cc/l |

When washed with cold and hot water and then dried, the coil indicated a very bright surface.

EXAMPLE 11

Phosphor bronze worked into a lead frame for use with an integrated circuit was subjected to a pretreatment prior to silver plating by being immersed 15 seconds in a solution of the following composition:

| | |
|---|---|
| $H_2O_2$ | 40 g/l |
| $H_2SO_4$ | 150 g/l |
| $HBF_4$ | 10 g/l |
| Propionic acid | 10 g/l |

Thereafter, silver was plated on said phosphor bronze with a thickness of 3 microns. When the mass was heat treated for 1 hour at 290° C, no blister appeared on the plated surface. In a conventional method for the pretreatment, a solution consisting of 1 part of nitric acid and 3 parts of phosphoric acid has hitherto been used. However, this process has been obstructed by the annoying evolution of poisonous nitrogen oxide gas.

EXAMPLE 12

Scraps of tin-plated copper wires were immersed for 20 minutes at room temperature in a solution of the following composition:

| | |
|---|---|
| $H_2O_2$ | 2 g/l |
| $H_2SO_4$ | 50 g/l |
| NaF | 5 g/l |
| 8-oxyguinolin | 10 g/l |

in order to recover the base copper material. When the immersed scraps were water washed and then dried, the base copper material was all exposed with its natural color. Gravimetric chemical analysis showed that an amount of residual tin attached to the base copper material was smaller than 100 ppm, the lower limit of the chemical analysis. Further, some exposed base copper materials were melted off. These melted materials were mixed together into a single mass. Spectroscopic analysis of said mass indicated that an amount of residual tin was 25 ppm.

CONTROL 4

Scraps of the same kind of tin-plated copper wires as in Example 12 were immersed for 20 minutes in a solution of substantially the same composition as in Example 12 except for a sodium fluoride. When washed with water and then dried, the wires thus treated were found to be tainted by the white deposition of metastannic acid partly on the surfaces. Gravimetric chemical analysis of some wires thus treated showed that an amount of residual tin attached to the base copper material was 230 ppm.

EXAMPLE 13

Scraps of the same kind of tin-plated copper wires as in Example 12 were immersed for 20 minutes at room temperature in a solution of the following composition:

| | |
|---|---|
| $H_2O_2$ | 2 g/l |
| $H_2SO_4$ | 70 g/l |
| Artificial cryolite | 5 g/l |
| $Na_4P_2O_7$ | 15 g/l |

When washed with water and then dried, the base copper material was all exposed with its natural color. Spectroscopic analysis showed that an amount of residual tin sticking to said base copper material was 21 ppm.

EXAMPLE 14

A sheet of 10% tin — 80% lead alloy was immersed for 1 minute in a solution of the following composition and then washed with water.

| | |
|---|---|
| $NaBO_3 \cdot 4H_2O$ | 60 g/l |
| $HBF_4$ | 80 g/l |
| $CH_3COOH$ | 20 g/l |

Even when heated for 4 hours at 170° C after plated with copper, the sheet did not present any blister on the plated surface.

What is claimed is:

1. A solution for chemical dissolution treatment of tin or alloys thereof which comprises an aqueous solution consisting of 0.03 to 10 mole/l of an oxidizing agent, 0.1 to 10 gram ion/l in terms of hydrogen ion concentration of an acid, wherein the acid is at least one selected from the group consisting of sulfuric acid, sulfamic acid, phosphoric acid, hydrochloric acid and acetic acid, and 0.001 to 10 mole/l of at least one tin ion-stabilizing agent selected from the group consisting of an inorganic fluoric complex salt containing a fluorine atom as a ligand, a titanium salt, a trivalent chromium salt and a vanadium salt.

2. A solution for chemical dissolution treatment of tin or alloys thereof according to claim 1 wherein the tin ion-stabilizing agent is at least one compound selected from the group consisting of sodium fluoroborate, sodium hexafluorosilicate, potassium hexafluorotitanate, potassium hexafluorozirconate, artificial cryolite, titanium monosulfate, titanium disulfate, titanium trichloride, chromium sulfate, chromium alum, ammonium metavanadate and sodium orthovanadate.

3. A solution for chemical dissolution treatment of tin or alloys thereof according to claim 1 wherein the tin ion-stabilizing agent is a mixture of an inorganic fluoric complex salt containing a fluorine atom as a ligand and at least one compound selected from the group consisting of a titanium salt, a trivalent chromium salt, and a vanadium salt, said mixture being present in an amount of 0.001 to 10 mole/l.

4. A solution for chemical dissolution treatment of tin or alloys thereof according to claim 1 wherein the oxidizing agent is a peroxide.

5. A solution for chemical dissolution treatment of tin or alloys thereof according to claim 4 wherein the peroxide is hydrogen peroxide.

6. A solution for chemical dissolution treatment of tin or alloys thereof according to claim 4 wherein a peroxide-stabilizing agent is present.

7. A solution for chemical dissolution treatment of tin or alloys thereof according to claim 1 wherein the oxidizing agent is a salt of a metal having a nobler ionization tendency than tin.

8. A solution for chemical dissolution treatment of tin or alloys thereof according to claim 7 wherein the metal salt is a copper salt.

9. A solution for chemical dissolution treatment of tin or alloys thereof which comprises an aqueous solution comprising 0.03 to 10 mole/l of hydrogen peroxide, 0.1 to 10 gram ion/l in terms of hydrogen ion concentration of an acid selected from the group consisting of sulfuric acid, sulfamic acid, phosphoric acid, hydrochloric acid and acetic acid, and 0.001 to 10 mole/l of at least one tin ion-stabilizing agent selected from the group consisting of sodium fluoroborate, sodium hexafluorosilicate, potassium hexafluorotitanate, potassium hexafluorozirconate, artificial cryolite, titanium monosulfate, titanium disulfate, titanium trichloride, chromium sulfate, chromium alum, ammonium metavanadate and sodium orthovanadate.

* * * * *